United States Patent [19]

Montgomery

[11] Patent Number: 4,983,067

[45] Date of Patent: Jan. 8, 1991

[54] BOAT LIFT APPARATUS

[76] Inventor: David M. Montgomery, 8912 Crestwood Dr., Fort Worth, Tex. 76179

[21] Appl. No.: 490,484

[22] Filed: Mar. 8, 1990

[51] Int. Cl.[5] ..... B63C 3/06

[52] U.S. Cl. ..... 405/3; 114/44

[58] Field of Search ..... 405/1-7, 405/218, 219, 221; 114/44, 45, 48; 212/199, 267, 269; 414/678

[56] References Cited

U.S. PATENT DOCUMENTS

| | | | |
|---|---|---|---|
| 2,708,346 | 5/1955 | Smith | 405/3 |
| 2,888,152 | 5/1959 | Sugg | 414/678 |
| 3,565,271 | 2/1971 | Deck | 414/678 X |
| 4,432,664 | 2/1984 | Baldyga | 405/3 |
| 4,482,268 | 11/1984 | Stevenson et al. | 405/3 |
| 4,678,366 | 7/1987 | Williamson | 405/3 |
| 4,714,375 | 12/1987 | Stevenson et al. | 405/3 |
| 4,832,210 | 5/1989 | Wood | 212/200 |

*Primary Examiner*—David H. Corbin
*Attorney, Agent, or Firm*—Geoffrey A. Mantooth

[57] ABSTRACT

A lift apparatus has a load member, a lift cradle and a lifting arrangement. The load member has a rail or track portion which provides a path when raising and lowering the lift cradle. The load member also has a mounting portion for mounting the load member to an adjacent structure such as a dock, a pier or a wall. The mounting portion has a web, which stands off mounting hardware, such as a mounting plate, from the rail portion. The lift cradle has bearings for sliding along the rail portion. The bearings have a gap, which allow the bearings to slide along the rail portion without interference from the web. When the bearings are free of the web, the lift cradle can rotate, to deposit the load onto a dock. The lifting arrangement is rotatively coupled to the upper end of the load member, so as to rotate with the lift cradle.

21 Claims, 4 Drawing Sheets

BOAT LIFT APPARATUS

FIELD OF THE INVENTION

The present invention relates to apparatuses for raising and lowering a load such as a boat, jet ski or the like.

BACKGROUND OF THE INVENTION

Personal watercraft are small self-propelled boats that are used by one or two people. One such type of personal watercraft are jet skis. Jet skis, which are propelled by jets of water, are equipped with water pumps for propulsion. When a jet ski is not in use, it is desirable to store it out of the water. Because the water pump and peller can pick up debris if the jet ski is parked on a beach, it is desirable to store the jet ski on a dock or cradle.

Jet skis are very heavy, weighing between 230–450 pounds. Therefore, some sort of lifting apparatus is needed to lift the jet ski up onto a dock (and to lower the jet ski into the water). Various prior art dock lifts have been employed to lift small boats and jet skis up out of the water. They all suffer from the disadvantage of being unable to move the load onto the dock. Instead, the prior art dock lifts merely lift the load up out of the water; the load is positioned out over the water and not over the dock. This is disadvantageous because jet skis must be removed from the lift to be stored. Because jet skis are heavy, they are difficult to move horizontally from a position out over the water onto the dock. Furthermore, servicing the jet ski while it is located out over the water on prior art boat lifts is clumsy and difficult; the operator must lean out from the dock over the water. Unlike large boats, jet skis are too small to climb on board for some types of servicing; servicing is better performed when not on board the jet ski.

Thus, it is desirable to have a boat lift apparatus that not only raises the load out of the water to a desired vertical height, but also can move the load horizontally over the dock. The prior art boat lifts appear to be limited in their directional lifting capability by their mounting arrangements to a load-bearing structure such as the bottom of the water body or the adjacent dock structure. These mounting arrangements prevent movement of the load from a position over the water to a position over the dock.

The problems with the prior art boat lifts are alleviated somewhat by installing the lift on an inside corner of a boat dock, so that the lift is bounded by the dock on two sides. However, with such an arrangement, the load must still be moved from a position over the water onto the dock. Furthermore, many docks do not have such an inside corner.

SUMMARY OF THE INVENTION

It is an object of the present invention to provide a lift apparatus for raising and lowering loads, which apparatus permits horizontal movement of the load as well as vertical movement of the load.

It is another object of the present invention to provide a lift apparatus for raising and lowering small boats from the water onto a dock surface.

The lift apparatus of the present invention includes an elongated load member, a lift cradle and lifting means. The load member has track means extending between upper and lower ends of the load member and has mounting means located intermediate of said upper and lower ends. The mounting means is coupled to and stood off from the track means by standoff means. The mounting means is adapted to couple to structure that is located adjacent to the load member. The lift cradle comprises guide means for guiding the lift cradle along the track means. The guide means have bearing means for slidingly engaging the track means so as to slide thereon. The bearing means have gap means for receiving the standoff means so that the bearing means can slide between the upper and lower ends of the load member. The lift cradle also comprises arm means that are coupled to the guide means. The arm means protrude outwardly and are adapted to engage a load. The bearing means allows the lift cradle to turn about the track means when the bearing means gap is free of the standoff means. The lifting means is for raising and lowering the lift cradle along the track means. The lifting means is coupled to the upper end of the load member.

In one aspect, the lifting means is rotatably coupled to the upper end of the track means, wherein the lifting means can turn about the track means when the lift cradle turns about the track means.

In another aspect, the bearing means are made of a solid material and have low friction surfaces that are in contact with the track means so as to slide thereon. The bearing means are made of ultra high molecular weight polyethylene (UHMWPE).

In still a further aspect, the arm means pivot between a deployed position for engaging a load in a stowed position wherein the arm means extend in a generally parallel direction to the track means.

The lift apparatus of the present invention allows a load to be lifted up from a lower position, and then swung horizontally to a position over a dock or some other structure, thereby eliminating the laborious task of sliding the load horizontally from a position off of the dock to a position onto the dock. This is accomplished by mounting the load member to adjacent structure, such as the dock, with mounting means that is stood off from the track means by a standoff web. Thus, the mounting means does not interfere with the sliding movement of the lift cradle along the load member. Once the lift cradle is free of the mounting means and the standoff web, the lift cradle can be rotated to rotate the load onto the dock. Furthermore, the mounting means makes installation of the load member extremely simple, eliminating the need for heavy equipment.

DESCRIPTION OF PREFERRED EMBODIMENT

Figure 1:
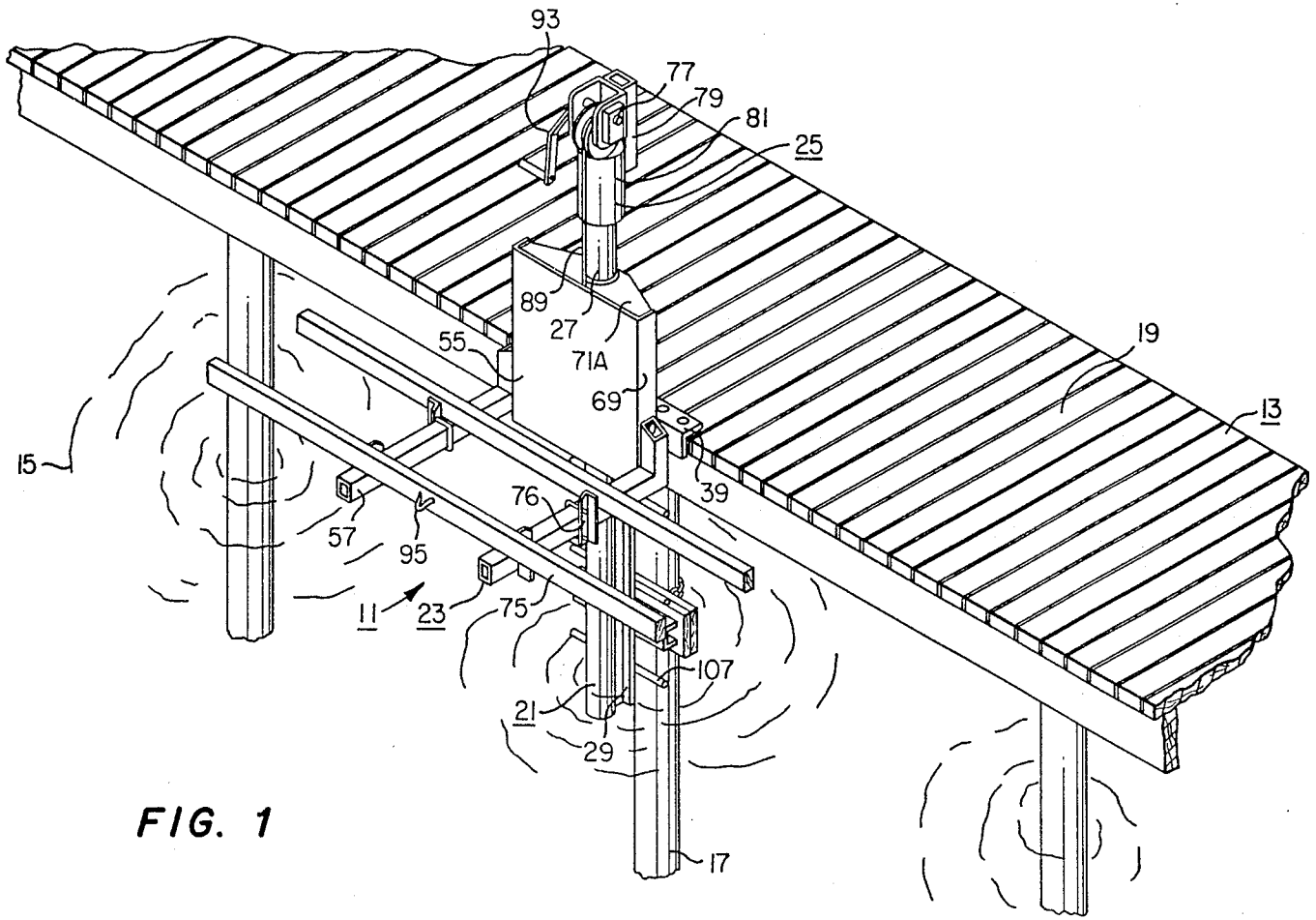
FIG. 1 is an isometric view of the lift apparatus of the present invention, in accordance with a preferred embodiment, shown mounted onto a dock with the cradle positioned over the water.

In FIG. 1, there is shown an isometric view of the lift apparatus 11 of the present invention, in accordance with a preferred embodiment. The lift apparatus 11 is shown mounted onto a dock 13. The dock, of course, extends out over water 15, and is supported by vertical piers 17 that are located along the sides of the dock. The lift apparatus is used to raise and lower small boats, such as jet skis or other types of personal watercraft, from the water 15 onto the dock walkway 19.

Referring to FIGS. 1–4, the lift apparatus 11 includes an elongated load member 21, a lift cradle 23 and lifting means 25.

The load member 21 provides a path for raising and lowering a load. The load member also transfers the weight of the lift apparatus and the load to the dock structure 13. The load member 21 has a rail portion 27 and a mounting portion 29. The rail portion 27 is a length of metal tubing, having upper and lower ends 31, 33. The upper end 31 is plugged so as to support the lifting means 25. The rail portion 27 serves as a track, upon which the cradle 23 can move up and down. The upper end portion of the rail portion allows the cradle to pivot horizontally about the rail portion. The mounting portion 29 has a web 35 and a mounting plate 37 that together form a T-shaped member when viewed in transverse cross-section (see FIG. 4). The web 35 protrudes radially outward from the tubing 27 so as to be perpendicular to a tangent of the tubing, which tangent is located at the juncture of the inner end of the web and the tubing. The mounting plate 37 is perpendicular to the outer end of the web 35. The web 35 acts as a standoff or spacer to space the mounting plate 37 or other mounting hardware (such as an angle iron 39) from the rail portion 27. Thus, there is a gap between the tubing 27 and each arm of the mounting plate 37, which gaps receive portions of the cradle 23 and also mounting apparatus for mounting the load member 21 to the dock 13. In the preferred embodiment, the mounting portion 29 is fabricated from an I-beam. The I-beam is cut longitudinally in half; one of the halves is then welded onto the tubing. The mounting portion 29 extends from the lower end 33 of the rail portion 27 to a point intermediate the upper and lower ends 31, 33 of the rail portion.

The load member 21 is installed by securing the mounting portion 29 to the dock 13 such that the load member is in a generally vertical orientation on the side of the dock. Once the lift apparatus 11 is installed, the dock 13 bears the weight of the apparatus and any load. To secure the mounting portion 29 to the dock, an angle iron 39 is coupled, by either welding or bolts, to the upper end of the mounting portion 29. The angle iron 39 may be welded directly to the web 35, after removing a segment of the mounting plate 37, or the angle iron 39 may be coupled to the mounting plate 37. The angle iron 39 is fitted onto the side of the dock walkway 19 so that one portion of the angle iron extends on top of the walkway and the other portion extends along the side edge of the walkway. The angle iron 39 is then secured to the walkway 19 with bolts. The load member 29 is then braced to the vertical pier 17 by way of a chain 40. A short length of U-shaped channel iron 41 is clamped to the mounting plate 37. Each arm of the mounting plate 37 is clamped between a clamping plate 43 and the channel iron 41. Bolts 45 provide the necessary clamping force. Interposed between the pier 17 and the channel iron 41 is a wooden spacer block 47. The thickness of the block 47 is such that the load member 21 is generally vertical. The block 47 has holes 49 therein for receiving eyebolts 51 that are secured to the channel iron 41. The chain 40 extends around the circumference of the pier 17 from eyebolt 51 to eyebolt. Before tightening the eyebolts 51 and the clamping plates 43, the chain 40 and the channel iron 41 can be slid up and down the length of the mounting plate 37 to a suitable location. The eyebolts 51 are then tightened, relative to the channel iron 41, to tighten the chain 40 around the pier 17.

When the load member 21 is installed onto the dock 13, the mounting portion 29 extends from the lower end 33 of the load member only up to the dock walkway 19. The rail portion 27 extends upwardly past the dock walkway 19 for some distance. The height of the upper end 31 of the rail portion 27 above the dock walkway 19 is such that the cradle 23 can be raised up and pivoted onto the dock 13, as will be explained in more detail hereinbelow.

Figure 3:
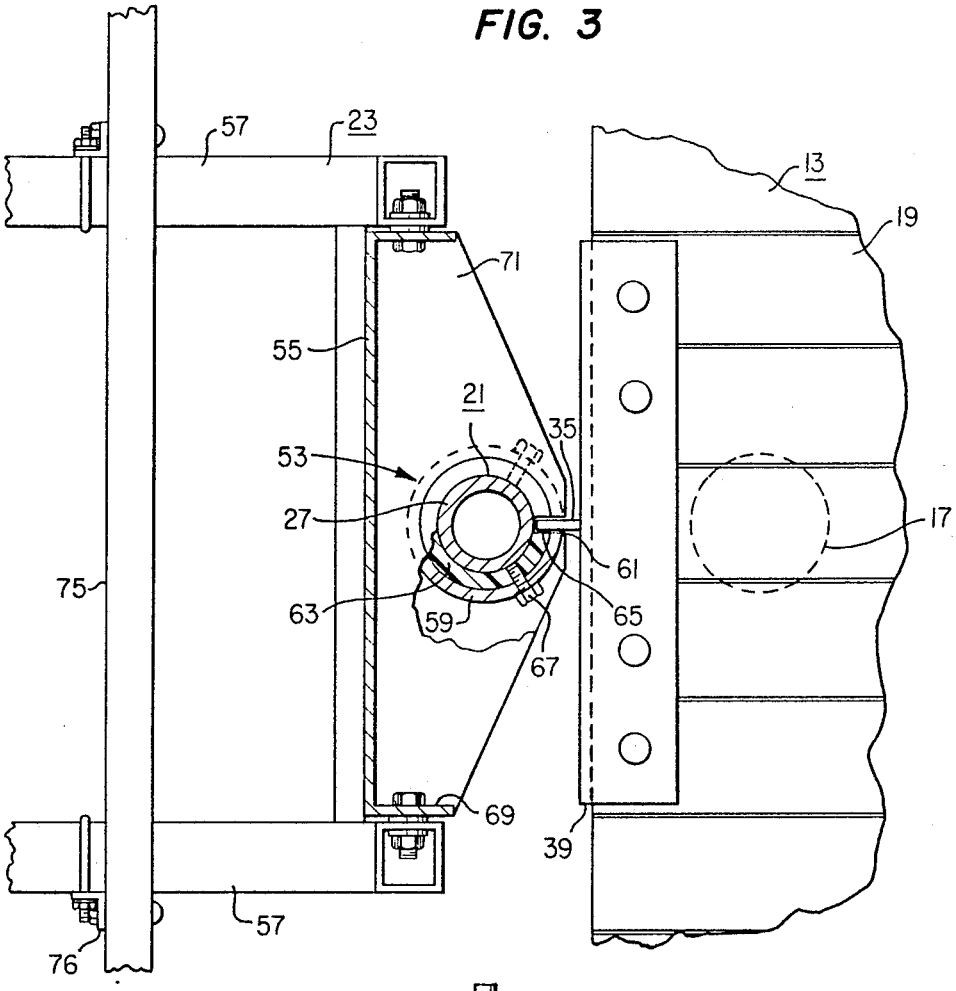
FIG. 3 is a transverse cross-sectional view, showing one of the bearings of the cradle and the dock surface.

The lift cradle 23 receives the load and is moved up and down the rail portion 27 of the load member 21. The lift cradle 23 includes guide means 53, a back wall 55 and arms 57. The guide means 53 includes short tubular segments 59 having an inside diameter that is larger than the outside diameter of the rail portion 27 tubing. Referring to FIG. 3, each tubular segment 59 has a longitudinal gap 61 therein. Secured to the inside of each tubular segment 59 is a plastic bearing 63. Each bearing 63 is tubular, having a length that is approximately the same as the length of the respective tubular segment 59. The bearings 63 each have a gap 65 that is aligned with the gap 61 in the respective tubular segment 59. The bearings 63 are secured to the tubular segments 59 by radially oriented bolts 67. The inside diameter of the bearings 63 is slightly larger than the outside diameter of the rail portion tubing 27 such that the bearings 63 will slide along the length of the rail portion.

In the preferred embodiment, the bearings 63 are made of commercially available ultra high molecular weight polyethylene (UHMWPE), an extremely dense plastic. The bearings 63 are made of solid UHMWPE, and are machined, molded or extruded to have smooth inside diameters. The bearings have low friction surfaces for sliding along the rail portion 27 and the web 35. Although UHMWPE is preferred because it is impact resistant and may be used in both fresh and salt water environments, other types of solid bearings could be used, such as, for example, polytetrafluoroethylene (TEFLON).

Figure 8:
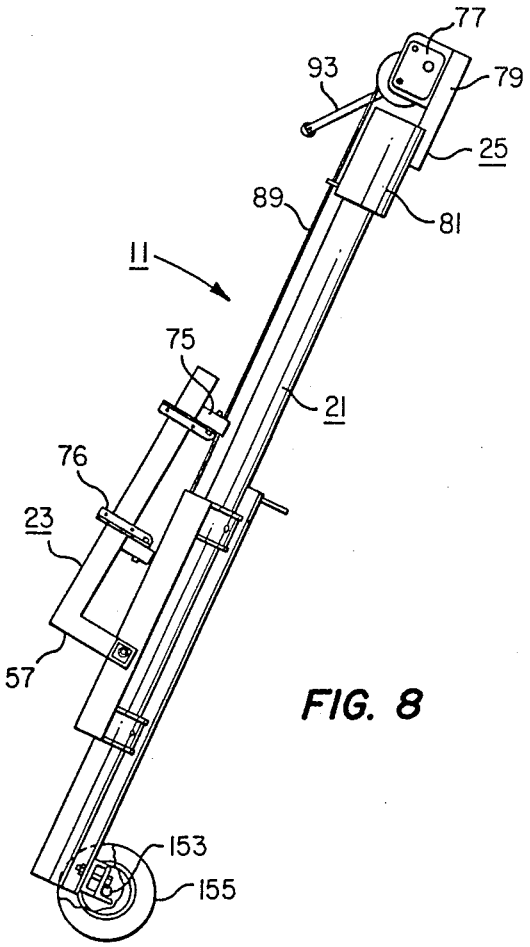
FIG. 8 is a side view of the lift apparatus, which is shown configured for wheeled transport to and from a dock site.

The back wall 55 is a large flat plate facing outwardly toward the load. The back wall 55 has side portions 69 that extend rearwardly away from the load. The guide means 53 are coupled to the back wall 55 by flat plates 71. The orientation of the back wall 55 is perpendicular to a radial line extending outwardly from the rail portion 27, when the cradle 23 is assembled onto the load member 71. The plates 71 are welded to the back wall 55 and to the tubular segments 59. Two plates 71 are provided per tubular segment 59, one of which is coupled to the top end of the tubular segment, with the other being secured to the bottom end. An arm 57 is pivotally coupled to each side portion 69 of the back wall 55. The arms 57 extend out in front of the back wall 55 to receive the load which is to be raised or lowered. In the preferred embodiment, the arms 57 are provided with a pair of wooden rails 75 for receiving a jet ski or other small boat. The rails 75, which are oriented perpendicularly to the arms 57, are coupled to the arms by way of mounting brackets 76. The arms 57 and rails 75 pivot between a deployed position as shown in FIG. 1, wherein the arms are generally perpendicular to the rail portion 27, and a stowed position as shown in FIG. 8, wherein the arms are generally parallel to the rail portion.

The lift cradle 23 is assembled onto the load member 21 as follows: the lift cradle 23 is raised up over the upper end 31 of the rail portion 27 and then lowered so that the rail portion 27 is received by the inside diameter of the bearings 63. Once both bearings 63 receive the rail portion 27, assembly of the cradle 23 onto the load member 21 is completed.

The lifting means 25 raises and lowers the lift cradle 23 and also rotates about the load member 21 with the lift cradle. The lifting means 25 includes a conventional brake winch 77, a riser 79 and a cap 81. The cap 81 is a hollow sleeve with one end 83 closed. The inside diameter of the cap 81 is greater than the outside diameter of the rail portion 27. Annular UHMWPE bearings 85 are located inside of the cap 81 and secured thereto with bolts. The inside diameter of the bearings 85 is slightly larger than the outside diameter of the rail portion 27. A top bearing 87 is provided inside of the cap 81 at the closed end 83. The top bearing 87 is a circular disk of UHMWPE plastic. Alternatively, a single cup-shaped bearing can be used in lieu of the plural bearings 85, 87. The cup-shaped bearing has a closed end, which abuts the top end 31 of the load member. The riser 79 is coupled to the outside of the cap 81 and extends vertically upward. The winch 77 is secured to the upper end of the riser 79.

The lifting means 25 is assembled onto the upper end 31 of the rail portion 27 such that the top bearing 87 abuts the plugged upper end 31 of the rail portion and the annular bearings 85 surround the rail portion. The cable 89 from the winch 77 extends from the winch spool 91 to the upper plate 71A (see FIG. 1) on the lift cradle 23, where it is secured. The winch 77 is provided with a handle 93 or an electric motor to raise and lower the lift cradle.

The operation of the lift apparatus 11 will now be described. With the lift cradle 23 oriented relative to the dock 13 as shown in FIG. 1, wherein the arms 57 point away from the dock, the cradle can be raised and lowered along the length of the rail portion 27. To pick up a load, such as a jet ski, the lift cradle 23 is lowered into the water 15 with the winch 77. As the cradle 23 is lowered, the bearings 63 slide along the rail portion 27. When the cradle 23 is lowered below the dock walkway 19, the web 35 of the mounting portion 29 is received by the gaps 61, 65 in the tubular segments 59 and the bearing 63 on the lift cradle. Thus, the C-shaped tubular segments 59 and bearings 63, with their respective gaps 61, 65, enable the cradle 23 to slide up and down the entire length of the rail portion 27, without interference from the mounting means 37, 39.

With the cradle 23 in the water 15, the jet ski (not shown) is loaded onto the rails 75. Then, the cradle and jet ski are raised with the winch 77. When the cradle 23 is loaded, there is a tendency for the cradle to tilt relative to the load member 21. This tendency is prevented by the bearings 63 which maintain the horizontal orientation of the arms 57. The bearings 63 resist the tilt and compressive forces of the cradle 23, while permitting rotation of the cradle at the upper end of the rail portion 27. In addition, the C-shaped bearings 63 maintain the cradle in an orientation wherein the arms 57 point out away from the dock 13, when the bearings are located along the mounting portion 29. The web 35 in the gaps 61, 65 prevents rotation of the bearings 63 around the rail portion 27, while permitting up and down sliding movements. The winch cap 81 also has a tendency to tilt relative to the load member 21, due to the load. The cap bearings 85 prevent such tilting of the cap 81.

Figure 2:
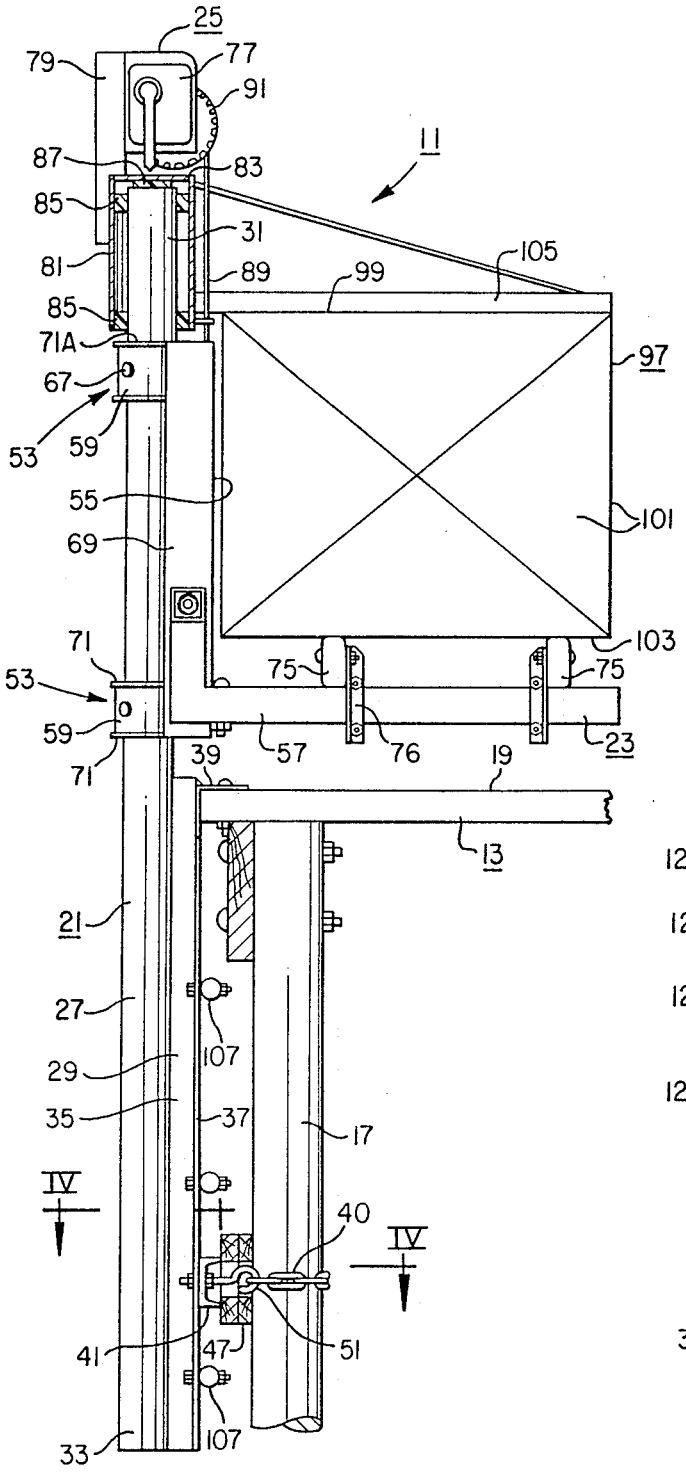
FIG. 2 is a side view of the lift apparatus of FIG. 1, shown with the cradle positioned over the dock and shown with an optional boat housing positioned over the cradle.

When the cradle 23 has been raised to the upper end portion of the load member 21, so that the bearings 63 are located above the mounting portion 29 and the gaps 61, 65 are free of the web 35, the cradle 23 is rotated 180 degrees relative to the load member in order to swing the cradle and the jet ski from a position over the water 15 (shown in FIG. 1) to a position over the dock 13 (shown in FIG. 2). Once the bearings 63 have cleared the mounting portion 29, the bearings are free to rotate on the rail portion 27 because the web 35 no longer constrains rotation. As the lift cradle 23 is rotated, the winch cap 81 is also rotated on the load member 21 to follow the cradle. Once the cradle 23 is over the dock 13, the jet ski can either be serviced while on the cradle or removed from the cradle and placed on a wheeled dolly. To lower the jet ski from the dock into the water, the process is reversed.

When the lift apparatus 11 is not in use, the cradle 23 may be rotated out over the water to clear the dock. Alternatively, the cradle arms 57 can be pivoted up to the stowed position, as shown in FIG. 8. The outboard rail 75 is provided with a hook 95 (see FIG. 1) to couple to the cable 89 when the arms 57 are in the stowed position. The hook 95 secures the arms 57 in the stowed position.

One aspect of the lift apparatus of the present invention is that lifting is simplified because both vertical and horizontal movement of the load are provided. The vertical movement allows the cradle 23 to slide up and down the rail portion 27 between the upper and lower ends 31, 33 of the rail portion. As will be explained hereinbelow, the rail portion 27, and even the mounting portion, can be extended both upwardly and downwardly, as the specific installation requires. The horizontal movement allows the cradle 23 to pivot or swing about the rail portion 27, so that the load can be moved between a position over the water and a position over the dock. Thus, a load can be lifted from the water and placed directly onto the dock.

This water-to-dock capability is due to the arrangement of the load member 21 and the cradle bearings 63. The load member 21 provides a track or rail 27 for guiding the cradle and the bearing in the vertical direction. The mounting plate 37 is stood off from the rail portion 27 by the web 35 so as not to interfere with the up and down movement of the bearings 63. The gaps 65 in the bearings 63 allow the bearings to slide along the web 35. When the bearings are free of the web 35, the cradle can rotate about the rail portion 27. By positioning the mounting portion 29 below the dock walkway 19, the cradle is free to rotate when located above the dock walkway.

Another aspect of the present invention is the flexibility in mounting arrangements to a structure provided by the mounting portion 29. The T-shaped mounting portion 29 that extends parallel to the rail portion 27 allows the load member 21 to be mounted to an adjacent load bearing structure such as a dock, a pier, a large boat transom, a wall, etc. The mounting portion 29 can be fastened to supporting or stabilizing structure by being bolted or clamped directly to such structure or indirectly by way of angle irons 39, chains 40, flat plates 130, etc. Alternatively, mounting means hardware in lieu of the mounting plate 37 can be coupled directly to the outer end of the web 35, such as is shown in FIG. 2 where the angle iron 39 is welded to the web 35. Thus, the mounting plate 37 can be used to couple the load member, or a mounting means substitution can be made for the mounting plate, which mounting means substitution is coupled to and stood off from the rail portion 27 by way of the web 35.

The mounting plate 37 simplifies installation of the load member onto the load bearing structure. No heavy equipment is required for installation, such as would be the case if load-bearing pilings were utilized. In the preferred embodiment, the mounting plate 37 is continuous to provide flexibility in choosing locations along the mounting plate, wherein the load member can be attached to a wide variety of structures. The mounting plate 37 allows plural load points for mounting the load member to a structure to distribute the load. However, the mounting plate need not be continuous, instead it can be fashioned in discrete segmented lengths along the rail portion. Also, the mounting plate need not extend up to the dock walkway if the mounting plate is coupled to the dock structure at a lower location.

The cradle 23 may be provided with a protective housing or covering 97 to shelter the jet ski, when the cradle is located at the upper end portion of the load member 21. The housing 97 is generally rectangular and has a top wall 99 and four side walls 101. The bottom 103 is open to receive the jet ski. The housing 97 is suspended by a suspension arm arrangement 105 which is coupled to the winch cap 81. Thus, as the jet ski is being raised from the water 15, it enters the housing 97 from the bottom 103. As the cradle 23 is rotated to over the dock, the housing 97 also rotates. One of the side walls 101 of the housing may be opened, to allow access to the interior.

In addition, the lift apparatus 11 may be provided with ladder rungs 107 on the load member 21, as shown in FIGS. 1 and 2. The rungs 107 allow an operator to climb up and down the load member. The rungs are bolted to the back of the mounting plate 37, so as to not to interfere with the up and down movement of the cradle 23 on the load member.

Figure 5:
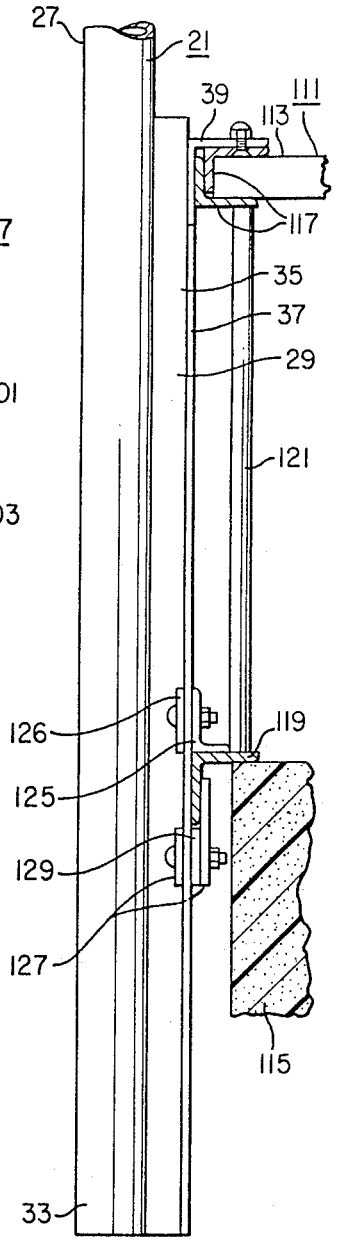
FIG. 5 is a side view of the lower portion of the load member shown mounted onto a floating dock.
Figure 6:
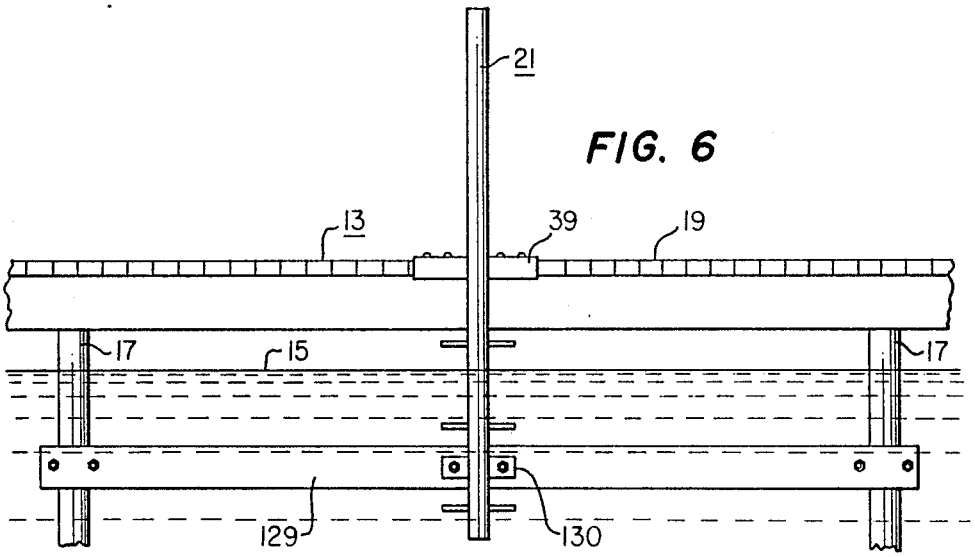
FIG. 6 is a front view of the load member shown mounted between two piers on a dock.

As described hereinabove, the lift apparatus 11 can be easily secured to a wide variety of structures. In FIGS. 5 and 6, the load member 21 is shown coupled to different types of docks. In FIG. 5, there is shown the load member 21 secured to a floating dock 111. The floating dock has an upper dock walkway 113 and a lower flotation mass 115. The dock 111 has horizontal angle irons 117 along the side of the walkway 113 and a horizontal angle iron 119 along the side of the flotation mass 115. The upper and lower angle irons 117, 119 are braced together by diagonal rods 121. The load member 21 is secured to the upper and lower angle irons 117, 119 at the mounting plate 37. The upper end of the mounting portion 29 is provided with an angle iron 39, which is secured to the edge of the dock walkway 113 and, more specifically, to the upper dock angle irons 117. Another angle iron 125 is clamped to the mounting plate 37 with a clamping plate 126 and is positioned to bear on the lower dock angle iron 119. The mounting portion 29 is also clamped to the lower dock angle iron 119 with clamping plates 127. A spacer plate 129, having the same thickness as the lower dock angle iron 119, is interposed between the mounting plate 37 and the rearward clamping plate 127. Thus, the lower dock angle iron 119 is interposed between the mounting plate 37 and the rearward clamping plate. The weight born by the load member 27 is distributed between the upper and lower dock members 117, 119.

Still another arrangement for securing the load member 21 to a boat dock is shown in FIG. 6. The load member 21 is again secured to the edge of the boat walkway 19, but at a location that is between two piers 17. In order to brace the lower end of the load member to stabilize the vertical orientation, a horizontal beam 129 is extended between the two adjacent piers 17. The lower end of the load member is then secured, by way of a flat plate 130 that is clamped or bolted to the mounting plate 37, to the beam 129. Besides stabilizing the vertical orientation, the beam 129 may be used to bear some of the weight, thus distributing the weight between the walkway 19 and the beam 129.

With the load member installed onto the floating dock of FIG. 5, or alternatively onto the beam of FIG. 6, the mounting portion 29 of the load member 21 does not extend upwardly beyond the dock walkway, to permit rotation of the cradle at the upper end of the load member. Furthermore, the cradle and lifting means are assembled and operated as described above.

Figure 7:
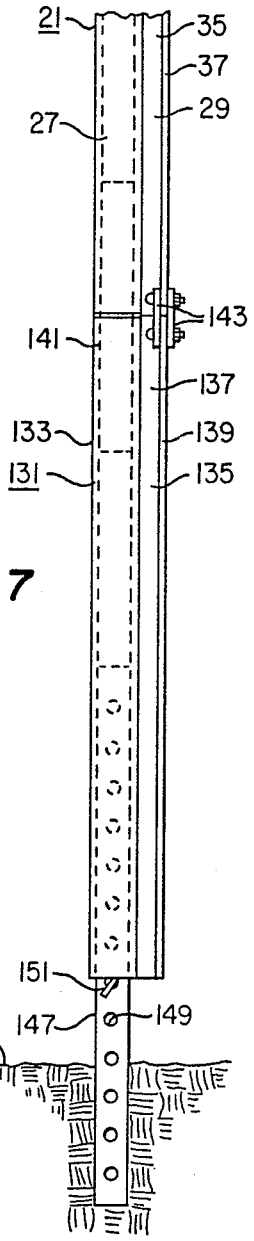
FIG. 7 is a side view of the load member shown with an extension load member which is anchored to the bottom of the water body.

The length of the load member 21 may be extended, as shown in FIG. 7, whenever required by the particular use to which the lift apparatus is put. The load member 21 is extended downwardly by providing an extension load member 131. The extension load member 131 has a rail portion 133 and a mounting portion 135. The mounting portion 135 has a web 137 and a mounting plate 139, which forms a T-shaped member. The mounting portion 135 is coupled to and extends along the length of the rail portion 133. The load member 21 and the extension load member 131 are aligned end to end. The two rail portions 27, 133 are coupled together by an insert 141 that is inserted into the inside diameters of the rail portions. The insert 141 has an interference fit with the rail portions. Alternatively, the insert can be threaded into the inside diameters of the rail portions. The two mounting portions 29, 135 are coupled together by pairs of clamping plates 143. Each pair of clamping plates 143 extends onto both mounting plates 37, 139. Thus, the extension load member is secured to the load member. The load member, and in particular the rail portion, can be extended upwardly by providing an extension rail portion and an insert to couple the two rail portions together.

Occasionally, it may be desired to anchor the lower end of the load member to the bottom 145 of the water body. Anchoring prevents movement of the lower end of the load member thus providing vertical stability of the load member. Furthermore, anchoring permits the bottom 145 to bear the load, wherein vertical stability is provided by bracing to some structure such as a dock. The load member is anchored to the bottom 145 by way of an extendable inner tube 147. The inner tube 147 has an outside diameter that is smaller than the inside diameter of the rail portion 133, so as to allow the insertion of the inner tube into the rail portion. The upper end of the inner tube 147 is retained inside of the load member and the lower end of the inner tube is secured in the bottom 145. The inner tube is provided along its length with plural holes 149 for receiving a pin 151.

Figure 4:
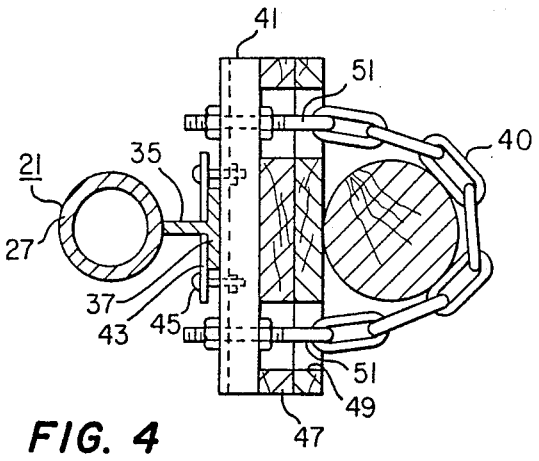
FIG. 4 is a cross-sectional view taken thrOugh lines IV—IV of FIG. 2.

The inner tube 147 is driven into the bottom 145 in the following manner. With the inner tube 147 bearing onto the bottom 145, the pin 151 is inserted into a hole 149 and the load member 21, 131 is placed over the upper end of the inner tube until the rail portion 133 bears on the pin 151. Then, the load member 21, 131 is picked up and dropped onto the pin 151, driving the inner tube 147 into the bottom 145 in a manner similar to driving a piling. As the inner tube is driven down, the pin 151 is advanced to upper holes to stay clear of the bottom 145. During the driving operation, the vertical orientation of the load member 21, 131 is stabilized by bracing to a pier 17, as shown in FIG. 4. The clamping plates 43 are loosened however, so as to allow the up and down movement of the load member.

The lift apparatus 11 is easily transported to and from the dock. Referring to FIG. 8, an axle 153 is clamped to the mounting plate 37 of the load member 21. Wheels 155 are rotatably coupled to the axle 153. With the wheels 155 located at the lower end of the load member, the load member 21 may be tilted back to serve as a dolly. The lifting means 25 and cradle 23 are assembled thereon, with the arms 57 of the cradle in the stowed position. Thus, the entire lifting apparatus 11 can be wheeled to and from the dock site.

The foregoing disclosure and the showings made in the drawings are merely illustrative of the principles of this invention and are not to be interpreted in a limiting sense.

I claim:

1. A lift apparatus, comprising:

(a) an elongated load member having track means extending between upper and lower ends of said load member and having mounting means located intermediate of said upper and lower ends, said mounting means being coupled to and stood off from said track means by standoff means, said mounting means being adapted to couple to structure located adjacent to said load member;

(b) a lift cradle comprising guide means and arm means, said guide means for guiding said lift cradle along said track means, said guide means having bearing means for slidingly engaging said track means so as to slide thereon, said bearing means having gap means for receiving said standoff means so that said bearing means can slide between said upper and lower ends of said load member;

(c) said arm means being coupled to said guide means, said arm means protruding outwardly and being adapted to engage a load;

(d) said bearing means allowing said lift cradle to turn about said track means when said bearing means gap is free of said standoff means;

(e) lifting means for raising and lowering said lift cradle along said track means, said lifting means being coupled to the upper end of said load member.

2. The lift apparatus of claim 1 wherein said lifting means is rotatively coupled to the upper end of said track means, wherein said lifting means can turn about said track means when said lift cradle turns about said track means.

3. The lift apparatus of claim 2 wherein said bearing means are made of a solid material and have low friction surfaces that are in contact with said track means so as to slide thereon.

4. The lift apparatus of claim 3 wherein said bearing means are made of ultra high molecular weight polyethylene.

5. The lift apparatus of claim 3 wherein said arm means pivot between a deployed position for engaging a load and a stowed position, wherein said arm means extend in a generally parallel direction to said track means.

6. The lift apparatus of claim 1 wherein said bearing means are made of a solid material and have low friction surfaces that are in contact with said track means so as to slide thereon.

7. The lift apparatus of claim 1 wherein said arm means pivot between a deployed position for engaging a load and a stowed position, wherein said arm means extend in a generally parallel direction to said track means.

8. A lift apparatus, comprising:

(a) an elongated load member having a cylindrical rail portion, web means and mounting means, said rail portion extending between upper and lower ends of said load member, said web means being longitudinally coupled to said rail portion at a location intermediate said upper and lower ends of said load member, such that said web means extends out therefrom to form a free end of said web means, said mounting means being coupled to said free end of said web means, said mounting means being adapted to mount said load member to an adjacent structure;

(b) a lift cradle comprising guide means for guiding said lift cradle along said rail portion and arm means, said guide means having C-shaped bearing means, said bearing means having an inside diameter that is sized such that said bearing means slidingly engage said rail portion, said bearing means having a longitudinal gap for receiving said web means such that said bearing means can slide along rail portion without interference from said web means;

(c) said arm means being coupled to said guide means, said arm means protruding outwardly and being adapted to engage a load;

(d) said lift cradle being capable of rotating about said rail portion when said bearing means is located at a location on said rail portion such that said bearing means gap is free of said web means;

(e) lifting means for raising and lowering said lift cradle along said track means, said lifting means being coupled to the upper end of said load member.

9. The lift apparatus of claim 8 wherein said lifting means is rotatively coupled to the upper end of said track means, wherein said lifting means can turn about said track means when said lift cradle turns about said track means.

10. The lift apparatus of claim 9, wherein said lifting means comprises a winch with a cable, said cable being coupled to said lift cradle, said winch being mounted on a capped sleeve which is rotatively coupled to said load member upper end.

11. The lift apparatus of claim 10 wherein said bearing means are made of a solid material and have low friction surfaces that are in contact with said track means so as to slide thereon.

12. The lift apparatus of claim 11 wherein said arm means pivot between a deployed position for engaging a load and a stowed position, wherein said arm means extend in a generally parallel direction to said track means.

13. The lift apparatus of claim 8 wherein said web means and said mounting means form a T-shaped member having arm portions and a stem portion, said stem portion including said web means and said arm portions including said mounting means.

14. The lift apparatus of claim 13 wherein said T-shaped member is elongated for a predetermined length so as to provide flexibility in choosing the locations on said T-shaped member in which to mount said load member to an adjacent structure.

15. The lift apparatus of claim 8 further comprising ladder rungs coupled to said load member by way of said mounting means.

16. The lift apparatus of claim 8 further comprising anchor means coupled to said lower end of said load member, said anchor means for anchoring said lower end to a bottom structure.

17. The lift apparatus of claim 8 further comprising housing means coupled to said lifting means, said housing means having an open bottom for receiving a load on said lift cradle when said lift cradle is adjacent to the upper end of said load member.

18. The lift apparatus of claim 8 further comprising an axle coupled to said mounting means at a location adjacent to the lower end of said load member, said axle being adapted to receiving wheels to provide wheeled transport of said lift apparatus.

19. The lift apparatus of claim 8 wherein said bearing means are made of a solid material and have low friction surfaces that are in contact with said track means so as to slide thereon.

20. The lift apparatus of claim 19 wherein said bearing means are made of ultra high molecular weight polyethylene.

21. The lift apparatus of claim 8 wherein said arm means pivot between a deployed position for engaging a load and a stowed position, wherein said arm means extend in a generally parallel direction to said track means.

* * * * *